United States Patent [19]

Wilson

[11] 4,182,149

[45] Jan. 8, 1980

[54] ROLL STAND

[75] Inventor: Alexander I. Wilson, Sheffield, England

[73] Assignee: Hille Engineering Company, Ltd., Sheffield, England

[21] Appl. No.: 855,193

[22] Filed: Nov. 28, 1977

Related U.S. Application Data

[63] Continuation of Ser. No. 741,668, Nov. 15, 1976, abandoned.

[30] Foreign Application Priority Data

Nov. 14, 1975 [GB] United Kingdom ..... 47037/75

[51] Int. Cl.[2] ..... B21B 29/00; B21B 31/26; B21B 35/12

[52] U.S. Cl. ..... 72/241; 72/244; 72/249; 72/247

[58] Field of Search ..... 72/241; 244, 249, 248, 72/237, 247, 239, 238, 235, 242

[56] References Cited

U.S. PATENT DOCUMENTS

| | | | |
|---|---|---|---|
| 3,243,983 | 4/1966 | Norlindh et al. | 72/235 |
| 3,364,714 | 1/1968 | Adair | 72/249 X |
| 3,686,919 | 8/1972 | Brusa | 72/249 |
| 3,718,026 | 2/1973 | Gawlikowicz et al. | 72/242 |
| 3,864,955 | 2/1975 | Eibe | 72/238 |
| 3,866,283 | 2/1975 | Gould | 72/238 |

*Primary Examiner*—Milton S. Mehr
*Attorney, Agent, or Firm*—Brisebois & Kruger

[57] ABSTRACT

A rolling mill stand, particularly for rolling rod, has two roll shafts each carrying a roll. Each roll shaft is carried by an eccentric shaft which also carries a drive shaft aligned with the roll shaft and coupled to it through a drive coupling permitting limited misalignment between the roll and drive shafts. An adjustment drive mechanism acts on the two eccentric shafts to turn them equally and oppositely and to cause the separation between the roll shafts and between the drive shafts to be altered. Each drive shaft has a gear drive consisting of a gear on the drive shaft meshing with a gear on an auxiliary drive shaft and the gears on the two auxiliary drive shafts mesh with one another.

19 Claims, 16 Drawing Figures

ROLL STAND

This is a continuation of application Ser. No. 741,668, filed Nov. 15, 1976, abandoned.

This invention relates to a roll stand, for rolling metal in elongate form, and is particularly, but not exclusively, concerned with a rod and bar mill stand for use in the continuous rolling of rod.

For the rolling of rod, it has previously been the practice to drive the rolls through drive spindles which are connected to the rolls and to the driving pinion box through universal couplings, which allow a limited degree of misalignment between the axes of the spindles and the connected shafts. Such a rod mill, which normally employed housings in which the roll chocks were mounted at a distance from the pinion box to reduce angularities of the spindles, was necessarily bulky. In particular, vertical stands, in which the roll axes were vertical, required a complicated mounting, in order to accommodate the long drive spindles; if the stand housing was mounted at floor level under-driven, an extensive pit was required to accommodate the spindles and the pinion box. If the rolls were driven from above, a large superstructure was necessary.

More recently, more compact rod mills have been developed usually having the rolls mounted in cantilever fashion; examples of such cantilever mills are described in British patent specifications Nos. 1089758 and 1281404. In the cantilever rod mills, the rolls were constituted by sleeves of suitable material, often tungsten carbide, mounted on the ends of roll shafts supported in bearings in the stand. The roll shafts were driven by means of gears secured on the roll shafts and meshing with gears on parallel drive shafts. The gears on the drive shafts were intermeshing, and one of those drive shafts was driven. The gear drive so produced avoided the need for drive spindles which are prone to vibration and excessive wear at high speeds, and, in addition, resulted in a more compact structure.

The previous gear-driven stands had severe limitations for the following reasons: during rolling, the rolls are of course subject to the rolling force which has the effect of bowing the roll shafts and that bowing is particularly pronounced in the case of cantilever mounted rolls. As the roll shafts carry the gears, the engagement between the roll shaft gears and the drive shaft gears is affected by bowing of the roll shafts. Unless special provision is made, there is the real danger that the bedding of the gears is so affected that excessive wear or failure occurs. It is obvious that the system can only be satisfactory for narrow gear face widths.

If the rolls, instead of being mounted at the ends of the roll shafts (cantilever), are carried between the roll shaft bearings, the degree of bending of the roll shafts is less, but can be serious enough again to affect the bedding of the drive gears.

One aim of the present invention is to prevent the bending of the roll shafts affecting the drive to the roll shafts. Thus, a rolling mill stand, according to the present invention, comprises a pair of parallel roll shafts, which include or are adapted to carry cooperating rolls; for each roll shaft, a drive shaft and a coupling between that drive shaft and its roll shaft; and roll gap adjustment means for varying the separation of the roll shafts, the adjustment means being effective on at least one of the roll shafts to adjust equally both that roll shaft and its drive shaft, whereby the coupling of that roll shaft is unaffected by roll gap adjustment.

The drive shafts can now carry gears meshing with drive gears on auxiliary shafts. Any bowing of the roll shafts that may occur does not affect the drive shafts and does not therefore alter the meshing of the gears.

While the invention is applicable to a mill stand in which the rolls are mounted in cantilever fashion on the roll shafts, it is preferred to have the roll on each roll shaft located between roll shaft bearings, in order to reduce the bending of the roll shafts resulting from the rolling load. The latter arrangement of the rolls has further advantages over the cantilever mill. Thus, the deflection of the roll shafts enforces a severe limitation on the length of roll surface that can be utilised for rolling, as otherwise a rolling load applied too far from the nearer bearing results in excessive deflections.

Special hard materials, such as tungsten carbide, have been employed increasingly as the material for the roll sleeves. Such hard materials have a number of marked advantages; they enable the rolls to have a smaller diameter, without attendant high wear rate, and therefore permit a higher reduction per pass than less hard material, due to the more favourable roll radius to stock height spread characteristics. Even using smaller diameter rolls, a roll life many times that of a conventional roll has been obtained and a better surface quality attained on the rolled material. Because of the high life, it has been commercially possible to use tungsten carbide rolls with a small roll barrel length and with generally a maximim of two grooves or passes, per roll.

For the reasons already given, the number of grooves or passes in a roll must be limited in a cantilever mill, since otherwise the roll shaft deflections become excessive. Therefore it has been the practice to apply at most two passes, the roll sleeve being removed from the roll shaft and reversed, in order to bring the second pass into use and into alignment with the pass line of the train of stands; in that way, the groove in use is always that nearer the main bearing of the roll shaft.

The use of a maximum of two grooves per roll has a limiting effect on the operational and economic value of the hard materials for the roll sleeves. By utilising roll shafts, in which the rolls are located between bearings, it is possible in the present invention to utilise roll sleeves having a relatively large number of passes or grooves, since, firstly, the bending of the roll shafts in such a stand are less than those in a cantilever stand, and, secondly, the provision of the couplings between the roll shafts and the drive shafts results in such bending that does occur being isolated from the driving gears, the couplings being designed to permit a limited degree of misalignment between the roll shaft and the drive shafts sufficient to accommodate the bending of the roll shafts.

In order that any of a number of rolling grooves may be brought into alignment with the pass-line, each roll shaft is preferably axially adjustable, the couplings being operative for all adjusted axial positions of the roll shafts.

The adjustment means preferably comprises, for at least one of the roll shafts, an eccentrically journalled shaft, on which are rotatably mounted separate carriers for the roll shaft and its drive shaft. However, other forms of adjustment means which apply equal adjustments to the roll shaft and drive shaft may be employed, such as wedges and screws.

In order that the rolls may be adjusted equally about the pass-line, it is preferred to have a separate eccentrically journalled shaft for each of the roll shafts, and drive means for rotating the eccentric shafts equally and oppositely.

The provision of separate, but coupled, roll shafts and drive shafts has the further advantage of facilitating roll change. The roll shafts may then be removed, without altering in any way the drive shafts and the driving gearing when provided.

It is a subsidiary feature of the invention that the roll stand may have a housing which supports the roll shafts and the drive shafts and which has outwardly extending, hollow, mounting trunnions aligned with the pass-line for passage of the work to and from the roll. The stand may then be mounted either with the axes of the roll shafts horizontal, or with those axes vertical.

According to another aspect of the invention, a roll stand has an input drive shaft which is substantially parallel to the rolling line, or pass-line, of the work. By arranging the input drive shafts in that way the torque reaction of the drive is at right angles to the pass-line and has no component in the direction of the pass-line. It is then possible, by measuring the reaction of the stand on its support in the pass-line direction to detect the tension of the work being rolled. In a multi-stand mill, that reaction measurement may be employed to control stand speed to maintain interstand tensions at zero or some finite value. That in turn makes it possible to dispense with the normal loop between stands, and therefore to reduce the separation of adjacent stands.

While the invention is intended primarily for roll stands for rolling rod, the possibility of using roll sleeves of relatively high axial length makes it possible to have grooves for rolling sections other than rods.

The invention will be more readily understood by way of example from the following description of a mill stand in accordance therewith, intended primarily for rolling rod, reference being made to the accompanying drawings, in which.

Figure 4A:
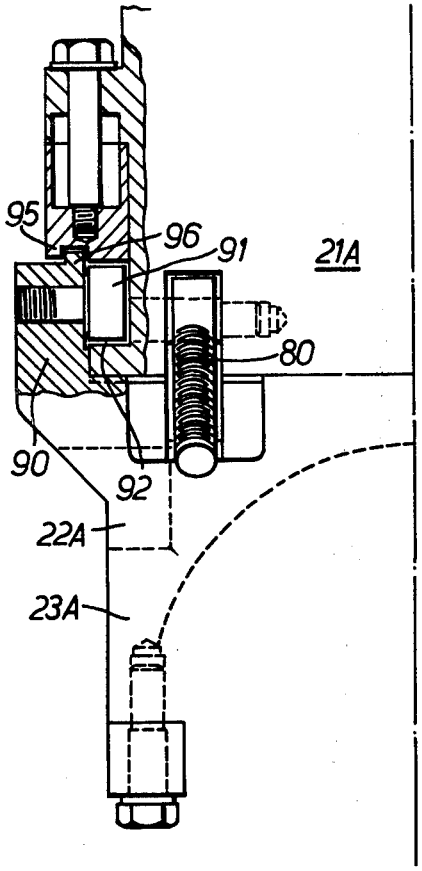
Figure 4B:
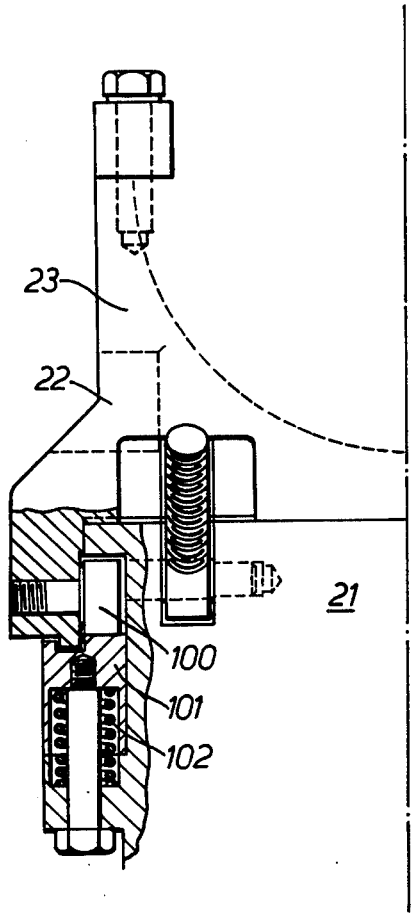
Figure 5:
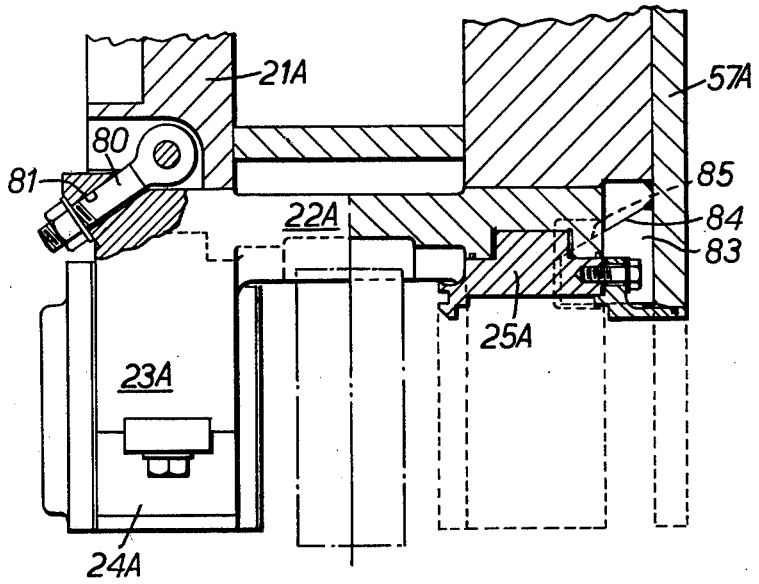
Figure 8:
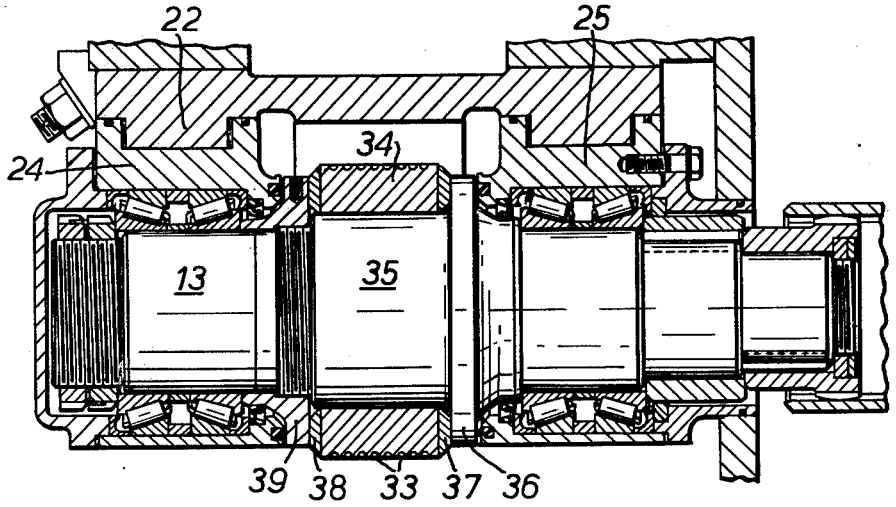
Figure 6:
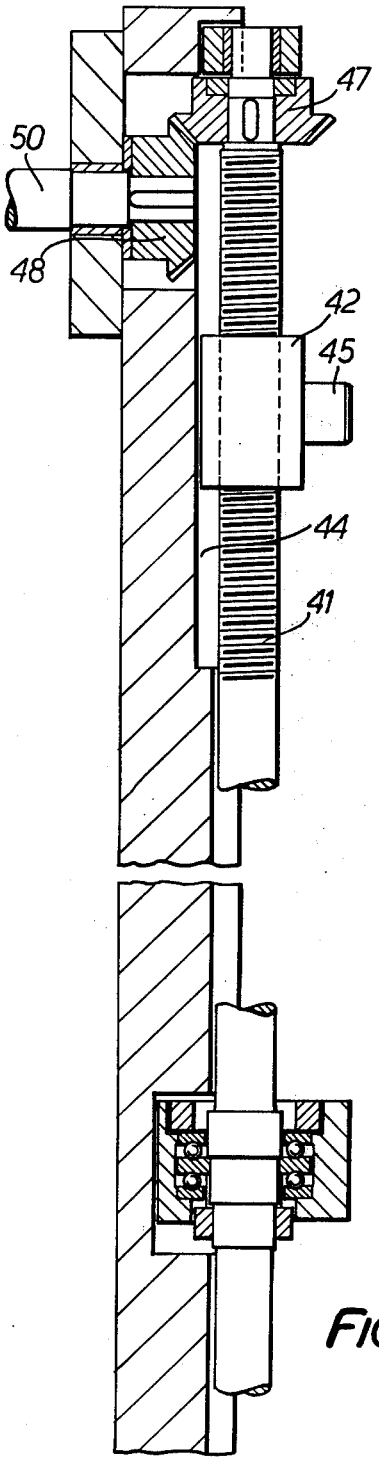
Figure 7:
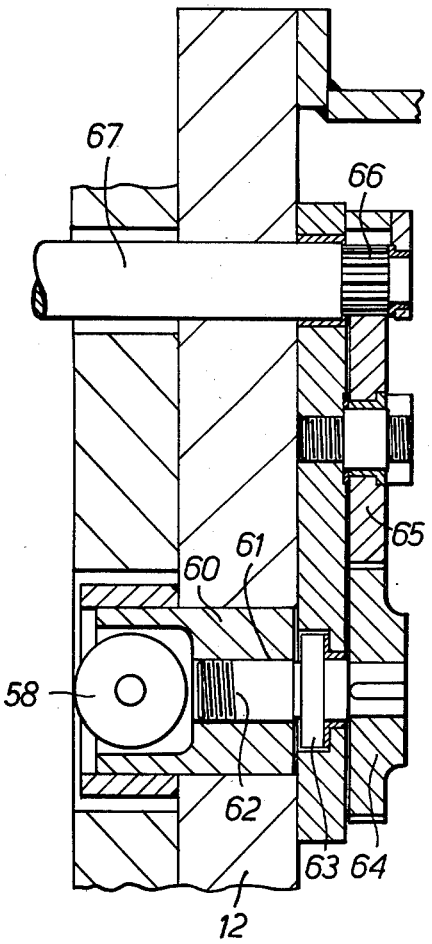
Figure 9:
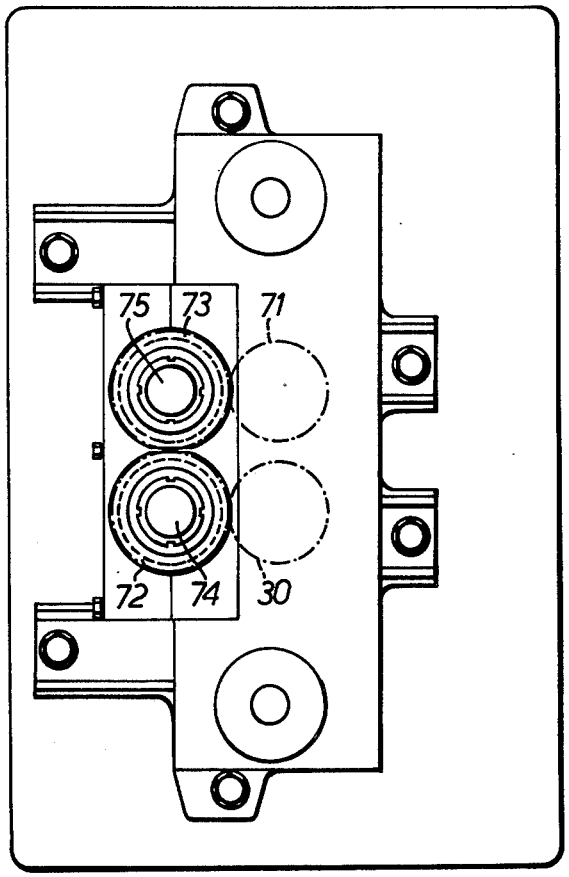
Figure 10:
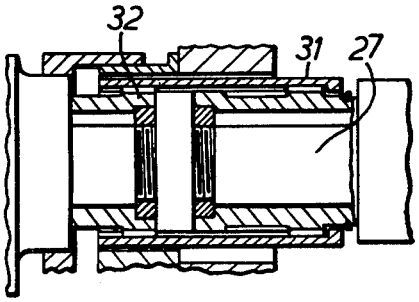
Figure 11:
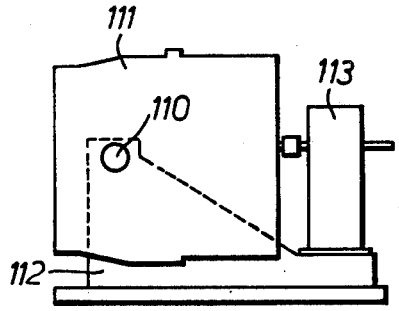
Figure 12:
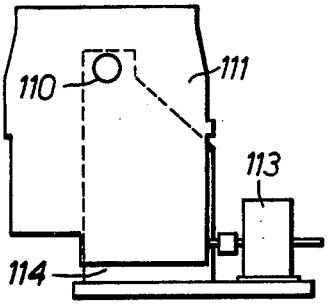
Figure 13:
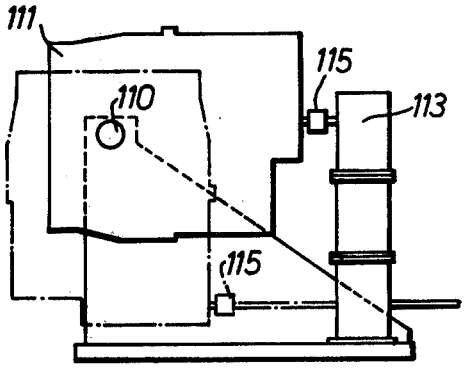
Figure 14:
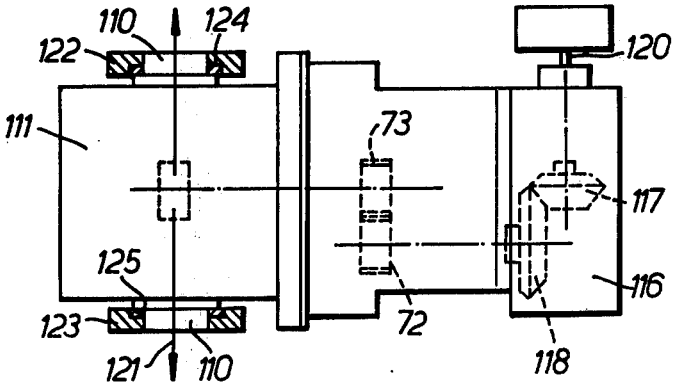
Figure 15:
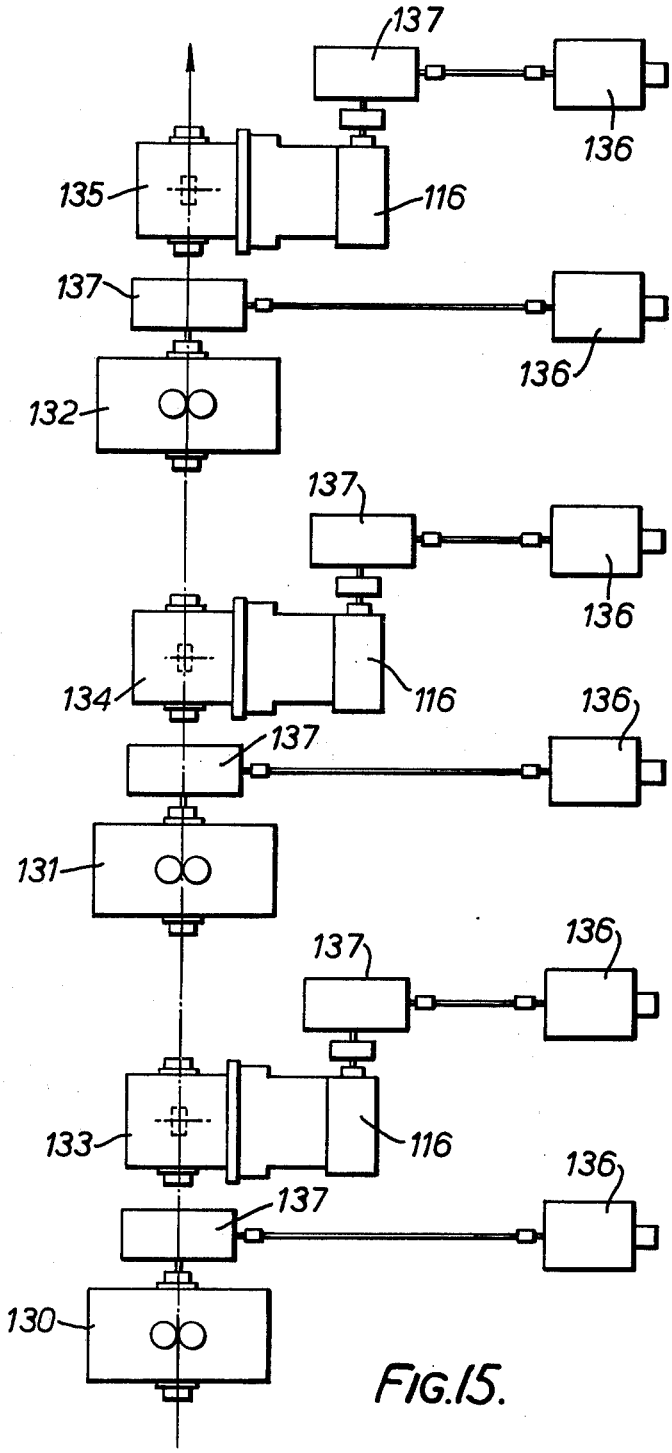

FIGS. 4*a* and 4*b* are half-front views of the roll carriers of the upper roll shaft and lower roll shaft respectively, FIG. 5 shows the mounting of the upper roll carrier, partly in section, FIG. 6 illustrates on an enlarged scale the mechanism for adjusting roll gap, FIG. 7 similarly illustrates the mechanism for axial adjustment of a roll shaft, FIG. 8 shows on an enlarged scale one of the roll shafts and its roll, FIG. 9 shows the drive to the drive shafts, FIG. 10 shows on an enlarged scale the coupling between one of the roll shafts and its drive shaft, FIGS. 11, 12 and 13 are sketches showing different mountings of the stand, FIG. 14 is a plan view of the stand showing a preferred arrangement of the drive, and FIG. 15 shows a train of rod mill stands.

The roller stand illustrated in FIGS. 1 to 9 has a housing, which includes a central vertical plate 12, and in which are located upper and lower roll shafts, the lower roll shaft being shown at 13. The two roll shafts are identical, and are similarly mounted and, accordingly, only the lower roll shaft 13 and its mounting will be described.

Figure 2:
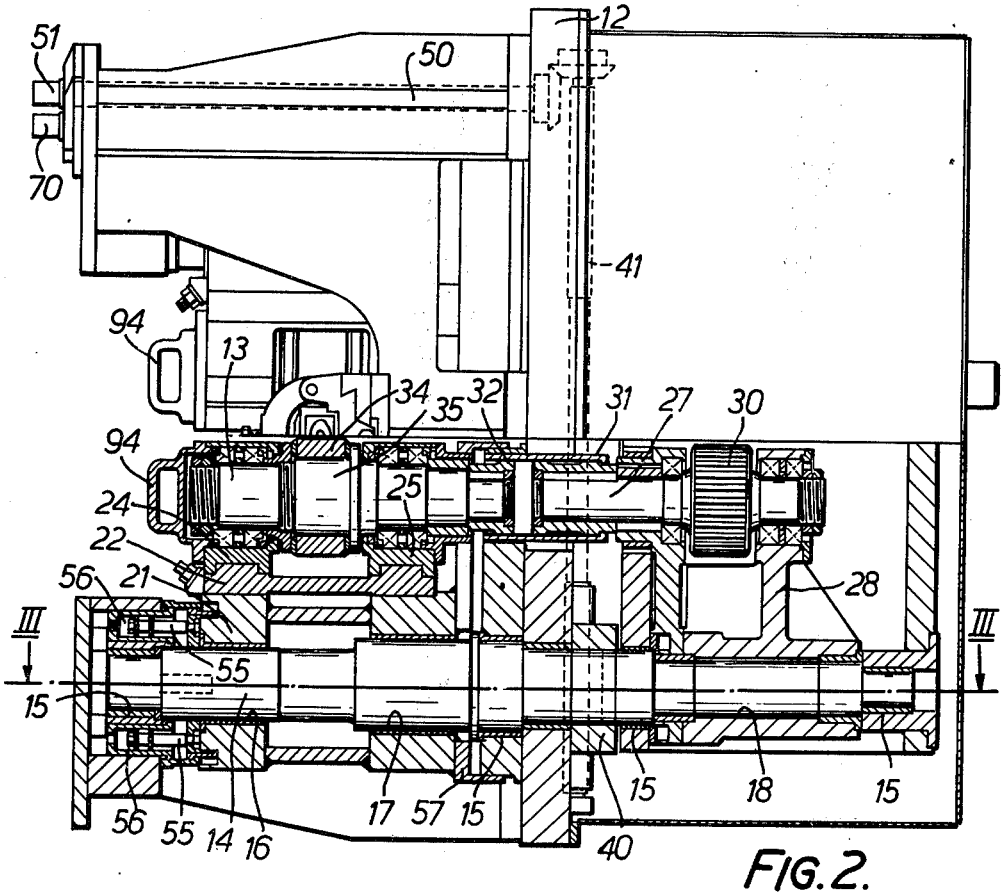
FIG. 2 is a section on the line II—II of FIG. 1.

The two roll shafts are parallel and are supported by two adjustment shafts, that for the lower roll shaft 13 being shown in FIG. 2 at 14. The adjustment shafts 14 are parallel to the roll shafts and are slightly offset from the plane through the roll shaft axes. In the embodiment shown, the adjustment shafts are eccentric shafts, the adjustment shaft 14 being journalled in the housing by bearings 15 and having eccentric portions 16, 17 and 18. Although the adjustment shaft 14 can be a single member, for convenience of manufacture, it is shown as two separate parts 14A and 14B, which are mounted co-axially and coupled together, as indicated at 20 in FIG. 3. The portions 16, 17 and 18 are equally eccentric with respect to the journal axis of the adjustment shaft 14.

An eccentric sleeve 21 is mounted on the eccentric portions 16 and 17 of adjustment shaft 14 and the roll shaft 13 is mounted on the sleeve 21 by means of a roll carrier 22 which is detachably secured to the sleeve 21, as will be described in detail later. The roll carrier 22 has two, spaced, horse-shoe, chock supports 23 (see FIG. 4*b*). Each of the supports 23 secures a bearing chock 24, 25, in which the roll shaft 13 is carried in bearings.

Each of the roll shafts has an aligned drive shaft, that for roll shaft 13 being indicated at 27 in FIG. 2. Drive shaft 27 is carried independently of roll shaft 13, being supported in a drive shaft carrier 28 which is journalled on eccentric portion 18 of adjustment shaft 14. Drive shaft 27 has a gear wheel 30 by which the drive shaft 27 and the roll shaft 13 are driven, as will be explained later. It will be appreciated that, as the sleeve 21 and the drive shaft carrier 28 are carried on eccentric portions of the adjustment shaft and as those portions have equal eccentricity, rotation of shaft 14 causes equal displacement of shafts 13 and 27, so that the alignment of the two shafts is maintained.

The adjacent ends of shaft 13 and 27 are spaced apart, but are coupled together by a sleeve coupling. The sleeve coupling consists of a sleeve 31 carried in overhanging manner on the end of shaft 27 and having internal teeth which mesh with teeth on shaft 27. The adjacent end of shaft 13 carries teeth 32 which also mesh with the internal teeth of sleeve 31. Teeth 32 are barrel shaped, so as to permit a limited degree of misalignment between the axes of shafts 13 and 27. By virtue of the sleeve coupling, the axial position of the roll shaft 13 may be adjusted relative to the housing and the drive shaft 27.

Each roll shaft has a roll barrel located between its roll chocks 24 and 25. Although the roll barrel may be integral with the shaft, it is preferred to have, as shown, a separate roll sleeve 34, which is made of a wear resistant material such as tungsten carbide, and which is secured to an arbor portion 35 of the roll shaft. FIG. 8 shows the mounting of the roll sleeve 34 in greater detail. The roll shaft has an integral flange 36 on one side of the arbor 35 and a guard ring 37 is interposed between the flange 36 and the roll sleeve 34 to prevent possible damage to the respective edge of the sleeve. Sleeve 34 itself is secured in known manner on the arbor 35, as by an interference fit, by the use of an adhesive, or by soldering. The left-hand edge of sleeve 34, as seen in FIG. 8, is protected by a second ring 38, which is held in place by the bearing structure 39 secured in chock 24. Sleeve 34 is formed with a series of rolling grooves 33 spaced along the barrel of the sleeve; those rolling grooves may have the same profile or different profiles.

It is important that the pass-line of the material rolled in the stand should be constant, both vertically and horizontally. On the other hand, it is necessary to adjust the separation of the roll shafts, to accommodate products of different dimensions and to accommodate roll wear. To maintain the pass-line constant, the two rolls are adjusted together symetrically about the pass-line.

Figure 3:
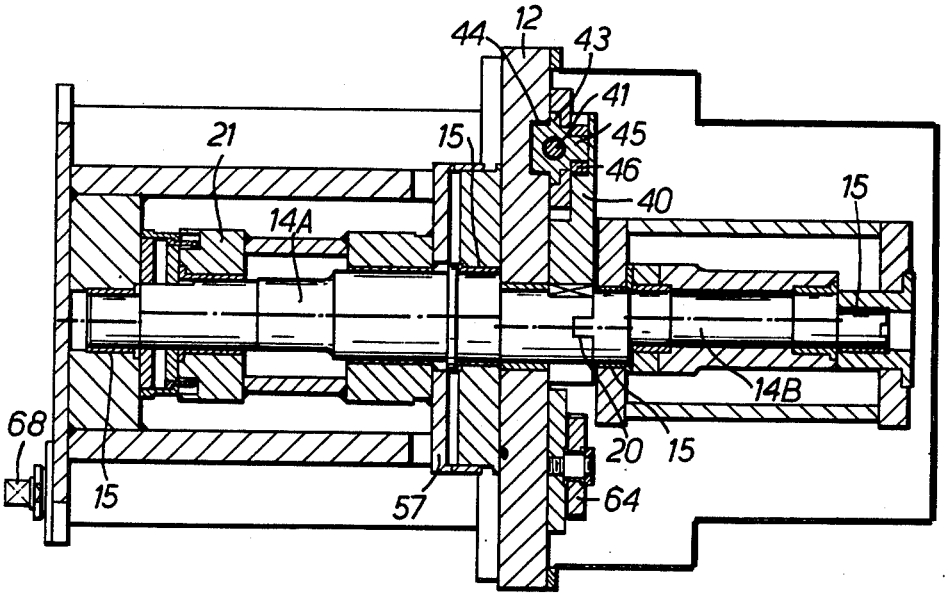
FIG. 3 is a section on the line III—III of FIG. 2.

Roll gap adjustment is performed by rotating the two eccentric shafts simultaneously and equally in opposite directions. Each adjustment shaft has keyed to it an arm which extends sideways from the shaft and which, in the case of adjustment shaft 14, is shown at 40. A spindle 41 (FIG. 6) is carried in bearings by the central plate 12 and extends vertically downwards to one side of the drive shafts and adjustment shafts. Spindle 41 has left-hand and right-hand threaded portions on which are mounted nuts 42 and 43 for the adjustment of the upper and lower adjustment shafts, respectively; as shown in FIG. 3, each nut is guided in a vertical slot 44 in the central plate 12. Each nut is formed with a spigot 45 which receives a ring 46 located in a transverse slot in one of the arms 40. Spindle 41 can be rotated through bevel gears 47, 48 (FIG. 6) by a shaft 50, which protrudes from the housing with a square end 51. Rotation of the protruding end 51 of shaft 50 thus causes nuts 42, 43 to be moved simultaneously in opposite directions along the spindle 41 and, through the arms 40, to cause opposite rotations of the two adjustment shafts.

Axial adjustment of the roll shafts is necessary in order to align a selected rolling groove 33 of each roll with the pass-line in the axial direction. Each of the roll shafts is independently axially adjustable and as the adjustment mechanism is the same for each roll, only that relating to roll shaft 13 will be described.

Figure 1:
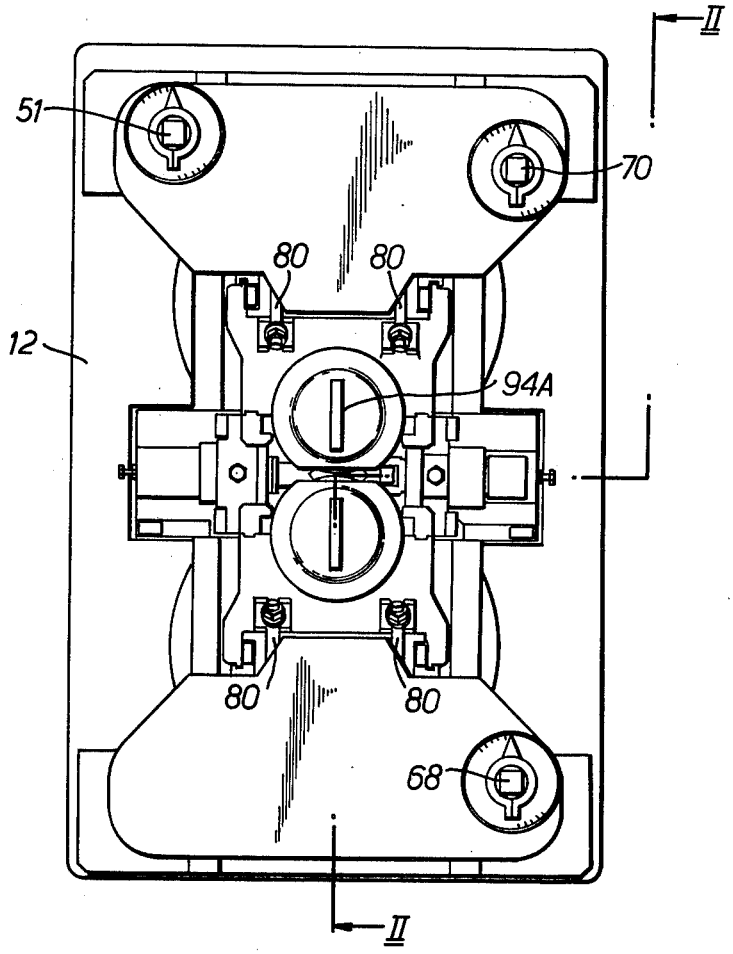
FIG. 1 is a front elevation of the stand.

Axial adjustment of roll shaft 13 is performed by moving the eccentric sleeve 21, and the parts carried by it, axially on the eccentric portions 16, 17 of adjustment shaft 14. As shown in FIG. 2, the piston rods 55 of two hydraulic piston and cylinder assemblies 56 act on the left-hand face of sleeve 21 and force it into engagement with an adjustable stop, which is shown in FIG. 7, and which engages a plate 57 welded to the right-hand end of sleeve 21, as shown in FIGS. 2 and 3. The stop, shown in FIG. 7, is constituted by a roller 58 carried by a block 60 in an opening in the central plate 12. Block 60 has a threaded bore 61 which receives a threaded shaft 62 connected to a thrust coupling 63 to a gear 64. Gear 64 is driven through an intermediate gear 65 by a gear 66 fast on a shaft 67, which passes through the housing and has an external square extremity 68 (FIGS. 1 and 3). Rotation of shaft 67 causes rotation of shaft 62 and therefore movement of roller 58 towards or away from the central plate 12. As the roller 58 determines the axial position of sleeve 21, the axial position of shaft 13 is determined by the rotation of shaft 67.

The axial position of the upper roll shaft is performed similarly, the termination of the adjustment shaft for that roll shaft being seen at 70 in FIGS. 1 and 2.

From FIG. 9 it will be seen that the gear 30 of drive shaft 27 and the corresponding gear 71 of the drive shaft of the upper roll shaft are in mesh respectively with a pair of gears 72, 73 which are carried by auxiliary shafts 74 and 75 respectively and which are in mesh with one another. Shaft 75 extends out of the housing and is coupled to a drive motor. Although gears 30 and 71 move vertically on adjustment of roll gap by means of the spindle 41, the movement of those gears relative to the meshing gear 72 and 73 is relatively small and the bedding of the gears is not affected.

The sleeve couplings between the drive shafts and the roll shafts not only permit axial adjustment of the roll shafts, as described, but also facilitate the removal of the roll shafts for roll change.

FIGS. 4*a* and 5 illustrate the detailed construction of the mounting for the upper roll shaft, pertinent to roll change. The parts in those Figures are given the same reference numerals with the suffix A as the corresponding parts for the lower roll shaft 13 and it will be understood that the mounting for the lower roll shaft is similar.

The upper roll carrier 22A one of the downwardly extending chock supports of which is shown at 23A is attached to the eccentric sleeve 21A by a pair of bolts 80 secured in recesses in the eccentric sleeve 21A and extending through inclined bores 81 in the roll carrier 22A. At the other end of the eccentric sleeve 21A, i.e. the end adjacent the drive shaft, the plate 57A secured to the eccentric sleeve carries members 83 having inclined, or wedge, faces 84. The roll carrier 22A has complementary inclined faces 85 which rest on faces 84. When the nuts of bolts 80 are tightened, the roll carrier 22A is forced to the right and up the inclined faces 84 to bring the right-hand end of the roll carrier into intimate contact with the eccentric sleeve 21A. At the same time, the left-hand end of the roll carrier 22A is forced up by the nuts, again into contact with the sleeve 21A.

As shown in FIG. 4*a* the roll carrier has wings 90 which extend upwardly at each side of the eccentric sleeve 21A and support wheels, one of which is shown at 91. There are two such wheels at each side of the sleeve 21A, and the wheels are normally held above and out of contact with rails formed by the lower surfaces 92 of recesses formed in the sides of the sleeve 21A. In order to remove the upper roll shaft from the stand, the nuts of bolts 80 are removed, allowing the roll carrier 22A to fall under gravity away from the sleeve 21A, until the wheels 91 rest on the rail-forming surfaces 92; if necessary, the roll gap is first increased, by operation of shaft 50 to allow the roll carrier to fall sufficiently without the rolls coming into contact. Then, the upper roll shaft can be rolled out of the housing by use of the handle 94A which is attached to the roll chock 24A. During the withdrawal of the roll shaft, the geared teeth at its right-hand extremity move along and out of the sleeve 31. During the withdrawal of the roll carrier, together with the roll shaft, transverse movement of the roll carrier relative to the eccentric sleeve 21A is prevented by keeper plates 95 bolted to the sides of the sleeve 21A and cooperating with upwardly extending flanges 96 on the wings 90.

The mounting and roll change arrangement of the lower roll shaft 13 is similar to that described for the upper roll shaft, the roll change wheels for the lower roller carrier 22 being indicated at 100 (FIG. 4*b*). In this case, however, it is necessary to provide means to cause the roll carrier 22 to move upwardly away from the eccentric sleeve 21 when bolts 80 are released so that the wheels 100 may roll on the rail-forming surfaces of the eccentric sleeve. For that purpose, the sleeve 21 carries two rails which are located below wheels 100, and one of which is shown in FIG. 4*b* at 101. Each rail 101 is urged upwardly by springs 102, one of which is shown at 102, into contact with wheels 100 of the roll carrier 22. When permitted by release of the bolts 80, the rails 101 urge the roll carrier upwardly away from the sleeve 21; the roll carrier can then be run out of the stand on the rails.

The insertion of new roll shafts into the stand is performed by reversing the procedure already described for the removal of the roll shafts. Thus, each roll shaft is rolled into the stand by means of the wheels 91 or 100, until the roll carrier engages the inclined faces 84. During the insertion of the roll carriers, the bolts 80 are introduced into the bore 81. On tightening the nuts on bolts 80, the roll carriers are then brought into proper working contact with the eccentric sleeves as described.

By having the gears 30, 71 on drive shafts (27) which are separate from the roller shafts (13), a number of advantages are obtained:

1. Any deflection of the roll shafts that may occur under the rolling load are isolated from the gears 30, 71, so that the bedding of those gears with the driving gear 72, 73 is not affected. The sleeve coupling 31 between each roll shaft and its drive shaft permits a limited degree of misalignment between the drive and roll shafts and therefore accommodates such deflection of the roll shaft as may occur.

2. The roll shafts can be adjusted axially, in order to select a particular rolling groove of the roll sleeves 34, again without affecting the gear drive.

3. Roll changing can be performed by removing and replacing the roll shafts, again without affecting the gear drive.

The non-cantilever type of mounting of the rolls has the advantage of enabling a relatively large roll barrel length to be employed and therefore a number of grooves substantially greater than the two normally provided in centilever stand rolls. There is the further advantage that the bending of the roll shafts is substantially less than that of a cantilever roll stand. However, it is possible, if desired, to replace the roll shafts illustrated in the drawings by similar shafts having the roll sleeves mounted at their free ends in cantilever fashion, the roll shafts being supported and adjusted by the eccentric shafts in a manner similar to that shown, although it is of course necessary to increase the size of the bearings closer to the roll sleeves.

Reverting to the stand illustrated in the drawings, the sleeves 34 may be permanently attached to the roll shafts which, because they are relatively inexpensive, may be scrapped at the end of the useful life of the sleeves. However, if desired the sleeves may be attached to the roll shafts, as by the use of low temperature solders or Bratt mountings, enabling the sleeves to be removed from the roll shafts when required. It is then necessary only to replace the sleeves when worn. Where the sleeves are to be permanently secured to the roll shafts, circumferential or spiral pockets 14 may be machined into the faces of the arbors 35 of the roll shafts and filled suitable fluxes and brazing material, which on cooling form a strong metallic bond between the sleeves and roll shafts; the sleeves may be shrink fits on the arbors, or a clearance left between them. Alternatively, the sleeves may be attached by the use of a suitable synthetic resin, by an interference fit.

Because of the gear drive to the roll shafts, and the absence of drive spindles, a compact mill stand results. That compactness in turn results in economy in the cost of the stand and its installation, and a reduction in the space required to locate a train of stands. The rod mill stand may be mounted with the axes of the roll shafts either horizontal, as illustrated, or vertical. Although not shown in FIGS. 1 to 10, the mounting on the stand is facilitated by providing opposite sides of the housing with hollow mounting trunnions 110, (FIGS. 11 to 13), the common axis on which is aligned with the rolling line of the stand passing between the roll sleeves 34. The stand is supported on the trunnions 110, as indicated in FIGS. 11 to 13, and the work enters the stand through one trunnion, passes between the operative rolling grooves of the roll sleeves, and leaves the stand through the other trunnion.

FIG. 11 shows the mounting of the stand with the roll axes horizontal, the stand being indicated generally at 111, with the trunnions 110 supported in a bed 112, which may also support a gearbox 113 for the drive, if necessary. The bed 112 may be secured in place, or may be mounted for sliding movement towards and away from the rolling line, in order to ease the removal of the stand from the line. Similarly, FIG. 12 shows the same stand mounted on the bed 114 with the axes of the rolls vertical; apart from the changes in the bed 114 necessitated by the altered attitude of the stand 111, the arrangement is similar to that of FIG. 11. FIG. 13 shows an arrangement, in which the stand 111 can be mounted with the axes of the rolls either vertical or horizontal as desired. In that case, the gearbox 113 has two output shafts for coupling quick release coupling 115 to the input shaft of the stand when in either position.

It is preferred to arrange that the axis of the input shaft to the stand is parallel to the rolling line. That feature is shown in FIG. 14, where the stand 111 has an extension 116 housing bevel gears 117 and 118. The input bevel gear 117 is fast on an input shaft 120 parallel to the pass line indicated at 121, while the driven bevel gear 118 is fast on the shaft of one of the auxiliary drive shafts carrying gears 72, 73. Because the input drive shaft 120 is parallel to the pass line 121, the torque reaction on the stand is perpendicular to the pass line and has no component in the direction of the pass line. As a consequence, the only externally applied force applied by the stand to the bed (represented in FIG. 14 by the rings 122 and 123) is that applied by the rolled material, in the form of inter-stand tension. That enables the inter-stand tension to be measured by including load sensing devices 124 and 125 around the trunnions 110 to measure the reaction forces on the bed.

Previously it has been necessary to throw a loop of the rod between consecutive stands, in order to obtain tension-free rolling. By using the inter-stand tension measuring devices 124 and 125, that expedient is no longer necessary, and the consecutive stands can be located much more closely together than has been previously possible, as illustrated in FIG. 15.

FIG. 15 shows a train of six stands, each being of the type illustrated in FIGS. 1 to 10, the first, third and fifth stands 130, 131 and 132 being arranged with the roll axes vertical, while the second, fourth and sixth stands 133, 134 and 135 are arranged with the roll axes horizontal. Each of the stands has bevel gearboxes 116, as described in relation to FIG. 14, the input shafts of those gearboxes being driven by independent motors 136 through further bevel gearboxes 137.

The tension into the first stand 130 is maintained at a datum value, usually zero, and the speeds of the various stands 130–135 are controlled by the load measuring devices 124, 125 on each stand, to maintain the inter-stand tensions at this same datum value. It may in fact be an advantage under certain conditions to set the datum value of inter-stand tension at a small finite value, since then the roll wear of the said stands can be improved, as the tension reduces the amount of slip between the work and the rolls. In addition a positive tension slightly reduces the pressure required to effect a desired reduction.

Because the input shafts are arranged parallel to the rolling line, it is a simple matter to disconnect the drive at the gearboxes 137, when these stands are to be removed from the rolling line, without removing shafts or having long splined shafts.

I claim:

1. A rolling mill stand comprising:

(a) a first roll shaft;

(b) a second roll shaft substantially parallel to said first roll shaft;

(c) first and second drive shafts for said first and second roll shafts respectively;

(d) first carrier means for supporting said first roll shaft and said first drive shaft;

(e) a first coupling between said first roll shaft and said first drive shaft;

(f) second carrier means for supporting said second roll shaft and said second drive shaft;

(g) a second coupling between said second roll shaft and said second drive shaft, and (h) roll gap adjustment means effective on at least one of said first and second carrier means for adjusting the separation of said first and second roll shafts;

(i) said roll gap adjustment means adjusting equally said roll shaft and said drive shaft of said at least one carrier means, whereby the disposition of said roll shaft relative to said drive shaft is unaltered and said couplings are substantially unaffected by roll gap adjustment.

2. A rolling mill stand according to claim 1, in which each drive shaft is substantially axially aligned with its roll shaft, and each coupling is designed to permit a limited degree of misalignment between its roll shaft and drive shaft.

3. A rolling mill stand according to claim 2, in which each coupling is a gear coupling.

4. A rolling mill stand according to claim 3, in which each roll shaft is axially adjustable, and each coupling is operative for all adjusted axial positions of its roll shaft.

5. A rolling mill stand according to claim 2, in which there is an auxiliary shaft for each drive shaft, and each auxiliary shaft has a pinion gear meshing with a gear on the associated drive shaft and with the pinion gear on the other auxiliary shaft.

6. A rolling mill stand according to claim 5, in which one of the auxiliary shafts is connected to the output of a gear box having an input shaft parallel to the pass-line of rolls of the roll shaft.

7. A rolling mill stand according to claim 1, in which each said roll shaft includes an arbor on which is secured a hard metal sleeve having rolling grooves therein.

8. A rolling mill stand according to claim 1, having a housing which has supporting trunnions aligned with the pass-line of rolls, with the plane through the axes of the rolls at any desired angle.

9. A rolling mill stand comprising:

(a) a first roll shaft;

(b) a second roll shaft substantially parallel to said first roll shaft;

(c) first and second drive shafts in substantial axial alignment with said first and second roll shafts respectively;

(d) first and second couplings between said first roll shaft and said first drive shaft and between said second roll shaft and said second drive shaft respectively;

(e) each said coupling permitting a limited degree of misalignment between its roll shaft and its drive shaft; and (f) roll gap adjustment means for varying the separation of said roll shafts, said adjustment means comprising, for at least one of said roll shafts;

(g) an eccentrically journalled shaft; and (h) first and second carriers mounted on said eccentrically journalled shaft carrying respectively one of said roll shafts and the drive shaft aligned therewith;

(i) rotation of said eccentrically journalled shaft causing equal adjustment of said first and second carriers.

10. A rolling mill stand according to claim 9, in which said carrier for the roll shaft is mounted for axial adjustment on the eccentrically journalled shaft and said coupling between that roll shaft and its drive shaft is operative for all adjusted axial positions of the roll shaft carrier.

11. A rolling mill stand according to claim 10, in which each coupling is a geared sleeve coupling.

12. A rolling mill stand according to claim 9, in which said eccentrically journalled shaft is in two connected axial parts which support respectively the roll shaft carrier and the drive shaft carrier.

13. A rolling mill stand comprising:

(a) a first roll shaft;

(b) a second roll shaft substantially parallel to said first roll shaft;

(c) first and second drive shafts in substantial axial alignment with said first and second roll shafts respectively;

(d) first and second couplings between said first roll shaft and said first drive shaft and between said second roll shaft and said second drive shaft respectively;

(e) each said coupling permitting a limited degree of misalignment between its roll shaft and its drive shaft; and (f) a first eccentrically journalled shaft;

(g) a first roll shaft carrier and a first drive shaft carrier mounted on said first eccentrically journalled shaft and carrying respectively said first roll shaft and said first drive shaft;

(h) a second eccentrically journalled shaft;

(i) a second roll shaft carrier and a second drive shaft carrier mounted on said second eccentrically journalled shaft and carrying respectively said second roll shaft and said second drive shaft; and (j) roll gap adjustment drive means for rotating said first and second eccentrically journalled shafts equally but in opposite senses.

14. A rolling mill stand according to claim 13, in which the adjustment drive means comprise a rotatable spindle carrying a pair of nuts, and arms fast on the eccentrically journalled shafts engaged by the nuts.

15. A rolling mill stand according to claim 13, in which each said roll shaft carrier is detachably secured to a sleeve rotatably mounted on its eccentric shaft, whereby the roll shaft is removable from the stand without affecting the eccentric shaft.

16. A rolling mill stand according to claim 15, in which the roll shaft carrier has wheels designed to run on rails formed on the sleeve to facilitate removal and entry of the roll shaft from and into the stand.

17. A rolling mill stand according to claim 13, in which each roll shaft has a pair of spaced bearing chocks, which are carried by the respective roll shaft carrier, and a roll barrel between the chocks.

18. A rolling mill stand comprising:

(a) a first roll shaft;

(b) a second roll shaft which is parallel to said first roll shaft;

(c) first and second drive shafts substantially aligned with said first and second roll shafts, respectively;

(d) first and second couplings between said first roll shaft and first drive shaft and between said second roll shaft and said second drive shaft, respectively, each said coupling permitting a limited degree of misalignment between its roll shaft and drive shaft;

(e) gears on said drive shafts;

(f) first and second auxiliary drive shafts;

(g) gears on said auxiliary drive shafts meshing with said gears on said first and second drive shafts;

(h) first adjustment means for varying equally the positions of said first roll shaft and said first drive shaft transversely to the axis of said first roll shaft;

(i) second adjustment means for varying equally the positions of said second roll shaft and said second drive shaft transversely to the axis of said second drive shaft; and (j) adjustment drive means to drive said first and second adjustment means simultaneously.

19. A rolling mill stand according to claim 18, further including, for each of said first and second roll shafts, a pair of bearing chocks supporting said roll shaft on opposite sides of the roll of that roll shaft.

* * * * *